US009556834B2

(12) United States Patent
Shigematsu

(10) Patent No.: US 9,556,834 B2
(45) Date of Patent: Jan. 31, 2017

(54) INTAKE SYSTEM

(71) Applicant: DENSO CORPORATION, Kariya, Aichi-pref. (JP)

(72) Inventor: Makoto Shigematsu, Nagakute (JP)

(73) Assignee: DENSO CORPORATION, Kariya (JP)

( * ) Notice: Subject to any disclaimer, the term of this patent is extended or adjusted under 35 U.S.C. 154(b) by 135 days.

(21) Appl. No.: 14/448,226

(22) Filed: Jul. 31, 2014

(65) Prior Publication Data

US 2015/0041699 A1 Feb. 12, 2015

(30) Foreign Application Priority Data

Aug. 8, 2013 (JP) ..... 2013-164893

(51) Int. Cl.
*F02M 35/10* (2006.01)
*F02B 27/02* (2006.01)

(52) U.S. Cl.
CPC ..... *F02M 35/10255* (2013.01); *F02B 27/02* (2013.01)

(58) Field of Classification Search
CPC ... F02M 35/10255; Y02T 10/146; F02B 27/02
USPC ..... 123/336, 337
See application file for complete search history.

(56) References Cited

U.S. PATENT DOCUMENTS 7,716,828 B2 * 5/2010 Miyauchi ..... B29C 45/1671 123/337
7,770,557 B2 * 8/2010 Ikeda ..... B29C 45/1671 123/337
8,464,689 B2 * 6/2013 Born ..... F02M 35/10085 123/337
2003/0101966 A1 * 6/2003 Hattori ..... F02B 27/02 123/337
2004/0055565 A1 * 3/2004 Yamamoto ..... F02B 27/02 123/337
2005/0022781 A1 * 2/2005 Arai ..... B29C 45/14754 123/337
2007/0084437 A1 * 4/2007 Winkelmuller ..... F02D 9/1015 123/336
2008/0029060 A1 * 2/2008 Ikeda ..... B29C 45/1671 123/337

(Continued)

FOREIGN PATENT DOCUMENTS

JP 2009-216066 9/2009
JP 2010-1847 1/2010

*Primary Examiner* — Joseph Dallo
(74) *Attorney, Agent, or Firm* — Nixon & Vanderhye P.C.

(57) ABSTRACT

The intake system has a valve seat, a plate valve, and an elastic sealing member. A path is provided to pass through the valve seat and to communicate with an intake passage of an internal combustion engine. The plate valve fits to or separates from the valve seat to close or open the path. The plate valve is provided with through holes passing through the plate valve in the thickness direction at a valve periphery part. The through holes are arranged linearly one after another in a peripheral direction of the plate valve to be offset to each other in the direction perpendicular to the peripheral direction. The elastic sealing member includes an elastic covering part that covers a first surface and a second surface of the plate valve and elastic coupling parts that are disposed in the through holes and are coupled with the elastic covering part at the first surface and the second surface.

15 Claims, 13 Drawing Sheets

(56) References Cited

U.S. PATENT DOCUMENTS

2009/0050106 A1* 2/2009 Bessho ..... F02D 9/1005
123/337
2009/0159043 A1* 6/2009 Asanuma ..... B29C 45/1671
123/337

* cited by examiner

INTAKE SYSTEM

CROSS REFERENCE TO RELATED APPLICATION

This application is based on Japanese Patent Application No. 2013-164893 filed on Aug. 8, 2013, the disclosure of which is incorporated herein by reference in its entirety.

TECHNICAL FIELD

The present disclosure relates to an intake system of an internal combustion engine, in which two surfaces of a plate valve opposite to each other are covered with an elastic sealing member at a periphery of the plate valve. The intake system will be referred to as a variable intake system hereafter.

BACKGROUND

Conventionally, the variable intake system is known to change a length of an intake passage through which intake air is supplied to an internal combustion engine (e.g., a combustion chamber in the internal combustion engine), based on an operation condition of the internal combustion engine. For example, Patent Document 1 (JP-2010-001847 A) and Patent Document 2 (JP-2009-216066 A) describe such a variable intake system.

According to Patent Document 1, a variable intake system has an intake manifold, an intake control valve, and an actuator. The intake manifold includes an annular protruding portion (e.g., an annular valve seat) protruding from an inner surface of an opening part that is provided at a curved wall surface of a connector. The intake control valve includes a valve body that is made of synthetic resin and is formed in a rectangular plate shape. The actuator operates a shaft of the intake control valve. The intake control valve further includes a sealing lip. The sealing lip is made of an elastomer and attached to an outer peripheral surface of the valve body. For example, the sealing lip is adhered to the outer peripheral surface by using an adhesive. When the sealing lip fits tightly to the annular valve seat that protrudes from the inner surface of the opening part, the opening part is fully closed and restricts intake air from leaking.

According to Patent Document 2, an intake control valve of a variable intake system has a valve shaft, a valve body, a base member, and an elastic spacer. The valve shaft is operated by an actuator. The valve body opens or closes a connecting hole provided by a periphery part, which is provided by a partition wall forming a chamber wall or an intake pipe. The base member rotates integrally with the valve shaft and supports the valve body to be relatively movable. The elastic spacer is made of an elastomer which is capable of deforming elastically. The elastic spacer is arranged between the valve body and the base member. The valve body includes a body member and an elastic sealing member. The body member substantially fully closes the connecting hole when the intake control valve is closed. The elastic sealing member is made of an elastomer. The elastic sealing member is arranged at a tip part of the body member and forms a tip part of the valve body. The elastic sealing member includes a sealing lip which is elastically deformed when the sealing lip fits tightly to a front edge of the periphery part provided by the partition wall.

According to Patent Document 1, the intake control valve used in the variable intake system has the valve body and the sealing lip. The valve body is made of the synthetic resin.

The sealing lip is made of the elastomer and attached to the outer peripheral surface of the valve body. Therefore, an adhesion process is required to adhere the sealing lip to the outer peripheral surface of the valve body by using the adhesive. Therefore, manufacturing cost increases. The manufacturing cost may decrease when the sealing lip is adhered to the outer peripheral surface of the valve body without using the adhesive. However, adhesive strength of the sealing lip with respect to the outer peripheral surface of the valve body decreases, and the sealing lip may be peeled partly or peeled off from the valve body. Accordingly, a clearance is provided between the valve body and the valve seat when the intake control valve is fully closed, and intake air leaks through the clearance. As the result, while the intake control valve is fully closed, a volume of intake air leaking through the clearance increases. That is, a sealing performance declines.

A thermoplastic elastomers may be used instead of the elastomer forming the sealing lip. However, an adhesive strength between the thermoplastic elastomer and the synthetic resin forming the valve body is lower than an adhesive strength between the elastomer and the synthetic resin. Accordingly, when the sealing lip is made of the thermoplastic elastomer, the sealing lip may separate easily from the valve body. Therefore, a clearance is provided between the valve body and the valve seat when the intake control valve is fully closed, and intake air leaks through the clearance. As the result, a volume of intake air that leaks through the clearance while the intake control valve is fully closed increases. That is, the sealing performance declines.

According to Patent Document 2, the intake control valve used in the variable intake system has the valve body including the body member and the elastic sealing member, the base member, and the elastic spacer. Further, the elastic sealing member is integrally molded with the elastic spacer to form an elastic part that is made of the elastomer and mounted to the intake control valve. Accordingly, manufacturing cost increases due to increase of the number of components and the number of assembly processes.

SUMMARY

The present disclosure addresses at least one of the above issues. Thus, it is an objective of the present disclosure to provide an intake system with which holding strength to hold an elastic sealing member can be increased, and strength of a plate valve itself can be restricted from decreasing. It is another objective of the present disclosure to provide the intake system with which to reduce a manufacturing cost. It is another objective of the present disclosure to provide the intake system with which to reduce a leaking amount of intake air in a condition where an intake control valve is fully closed by performing a great sealing effect.

The intake system has a valve seat, a plate valve, and an elastic sealing member. The valve seat is provided such that a path is provided to pass through the valve seat and to communicate with an intake passage of an internal combustion engine. The plate valve fits to the valve seat to close the path or separates from the valve seat to open the path. The elastic sealing member covers the plate valve from both sides in a thickness direction of the plate valve. The plate valve is provided with a valve periphery part and through holes passing through the plate valve in the thickness direction at the valve periphery part. The through holes are arranged linearly one after another in a peripheral direction of the plate valve so as to form rows, and the rows are arranged alternately with each other in a direction perpendicular to the peripheral direction and provide an arrangement pattern. The through holes are arranged in zigzag in the peripheral direction and are offset to each other in the direction perpendicular to the peripheral direction. The elastic sealing member includes an elastic covering part and elastic coupling parts. The elastic covering part covers a first surface and a second surface of the plate valve in the thickness direction at the valve periphery part. The elastic coupling parts are disposed in the through holes, respectively, to pass through the through holes and are coupled with the elastic covering part at the first surface and the second surface.

Since the elastic sealing member has the elastic covering part and the elastic coupling parts, the elastic sealing member can be fixed to the plate valve at the valve periphery part without having an adhesion layer between the elastic sealing member and the valve periphery part. Accordingly, holding strength to hold an elastic sealing member to the plate valve can be increased, and strength of a plate valve itself can be restricted from decreasing.

Further, a manufacturing cost can be reduced by omitting an adhesion process for adhering the elastic sealing member to the valve periphery part and by restricting an increase of the number components and assembling steps.

Moreover, according to the intake system of the present application, the leaking amount of intake air in the condition where an intake control valve is fully closed by performing a great sealing effect can be reduced, since the holding strength to hold an elastic sealing member to the plate valve can be increased.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Embodiments of the present disclosure will be described hereafter referring to drawings. In the embodiments, a part that corresponds to a matter described in a preceding embodiment may be assigned with the same reference number, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Figure 12A:
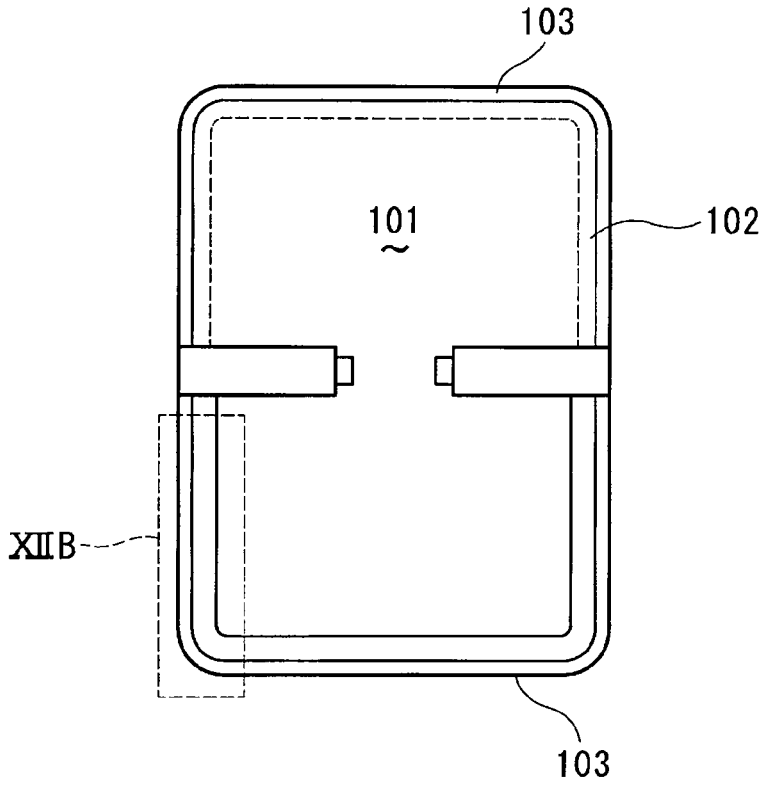
FIG. 12A is a schematic front view illustrating a plate valve according to a related art.
Figure 12B:
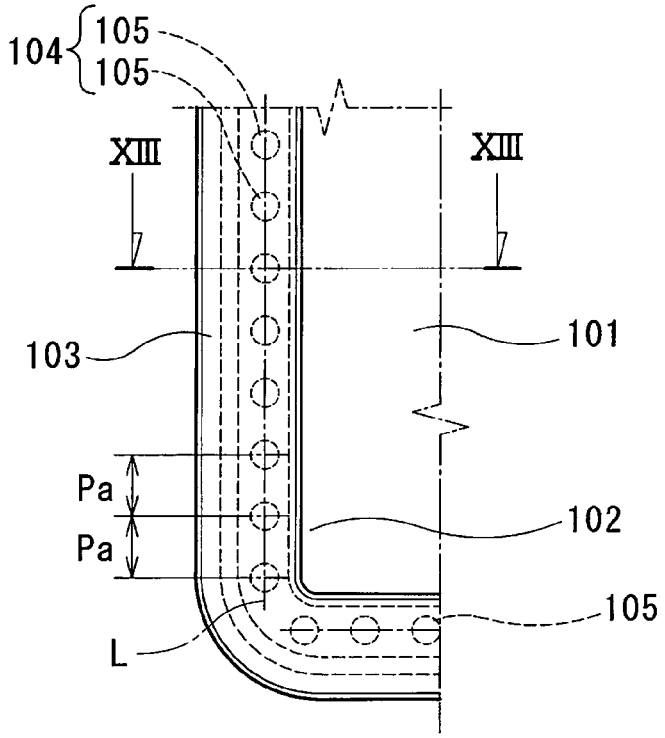
FIG. 12B is a partial enlarged front view of a part XIIB shown in FIG. 12A.
Figure 13:
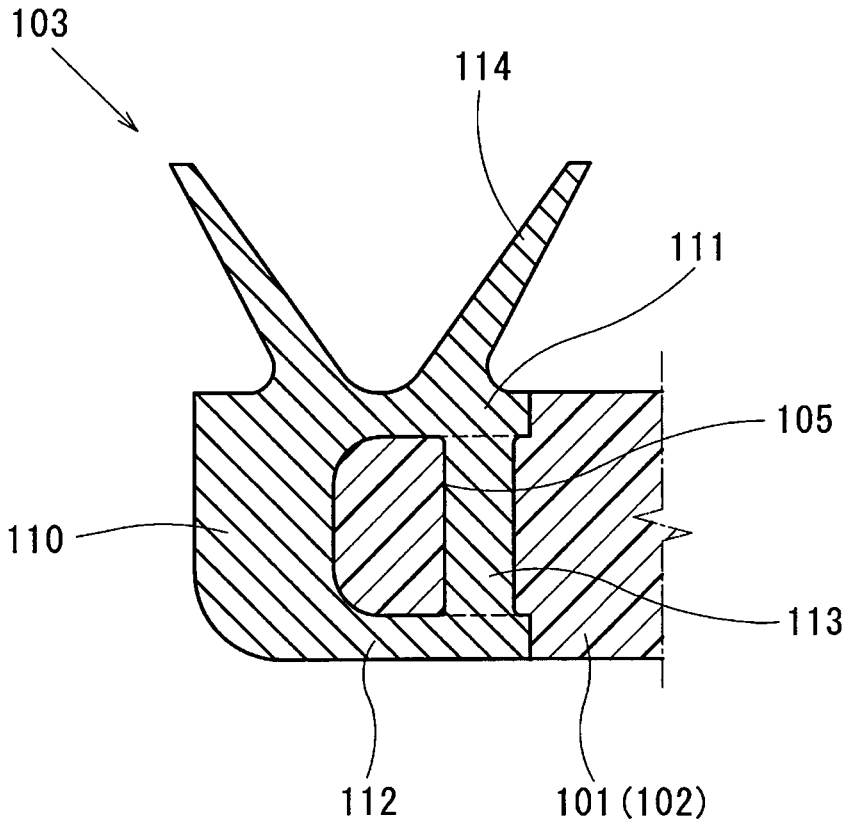
FIG. 13 is a cross-sectional view taken along a line XIII-XIII shown in FIG. 12B.

Previous to the present application, the inventor of the present application experimentally made a variable intake system shown in FIGS. 12A, 12B, and 13 to improve a sealing performance between a peripheral surface of a valve body and a sealing lip made of elastomer. The variable intake system has the intake control valve, and the intake control valve includes a butterfly valve 101 and an elastic sealing member 103. The butterfly valve 101 includes a valve periphery part 102, and the elastic sealing member 103 is adhered to the valve periphery part 102.

The plate valve 101 of the intake control valve is provided with an arrangement pattern. The arrangement pattern has through holes 105 that pass through the plate valve 101 in a thickness direction of the plate valve 101 at the valve periphery part 102. The arrangement pattern forms an annular band shape, in other words, the through holes 105 are arranged around the valve periphery part 102. Specifically, as shown in FIG. 12B, the through holes 105 are aligned one after another along an arrangement line (i.e., an arrangement axial line) L and form a row. The arrangement line L extends in a peripheral direction of the plate valve 101. The row formed by the through holes 105 is referred to as a row 104 hereafter. The through holes 105 forming the row 104 are arranged one after another at regular intervals Pa.

The elastic sealing member 103 includes a first elastic covering part 110, a second elastic covering part 111, a third elastic covering part 112, an elastic coupling part 113, and a sealing lip 114. The first elastic covering part 110 covers a first surface (i.e., an outer peripheral surface) of the plate valve 101. The second elastic covering part 111 covers a second surface (i.e., a top surface) of the plate valve 101 in the thickness direction. The third elastic covering part 112 covers a third surface (i.e., a bottom surface) of the plate valve 101 in the thickness direction. The elastic coupling part 113 is filled in each of the through holes 105 to pass through each of the through holes 105 in the thickness direction of the plate valve 101 such that the second elastic covering part 111 and the third elastic covering part 112 are connected with each other through the elastic coupling part 113. The sealing lip 114 protrudes from a surface of the second elastic covering part 111 and has a V-shape.

As described above, each of the through holes 105 is filled with the elastic coupling part 113 such that the second elastic covering part 111 and the third elastic covering part 112 are coupled with each other through the elastic coupling part 113. Further, the elastic sealing member 103 is adhered to the valve periphery part 102 of the plate valve 101 by using an adhesive. Accordingly, an adhesive strength for adhering the elastic sealing member 103 and the valve periphery part 102 to each other can be improved.

However, according to experiments of the inventor of the present application, the adhesive strength does not reach a required level when the regular intervals Pa, at which the through holes 105 are arranged, are large. Therefore, the regular intervals Pa are required to be shortened to increase the adhesive strength with a structure shown in FIG. 12B. However, if the number of the through holes 105, which pass through the valve periphery part 102 in the thickness direction of the plate valve 101, increases, a strength of the plate valve 101 itself may decrease.

(First Embodiment)

A variable intake system (i.e., a variable intake device) used in an internal combustion engine according to a first embodiment of the present application will be described referring to FIGS. 1 to 6. The internal combustion engine will be referred to as an engine (E/G) hereafter.

The variable intake system is used in a control mechanism (i.e., an engine control system) for the engine. The variable intake system includes an intake passage through which intake air is supplied to the engine for driving a vehicle such as an automobile. The variable intake system is capable of varying a length of the intake passage depending on an operation condition of the engine. The engine has cylinders (not shown), and each of the cylinders includes a combustion chamber (not shown) therein. The combustion chamber is communicated with an intake port (not shown) and an exhaust port (not shown).

The intake port of each of the cylinders is connected with an intake pipe (not shown) through an intake manifold 1 such that the intake air flows in the intake pipe. The exhaust port of each of the cylinders is connected with an exhaust pipe (not shown) through an exhaust manifold (not shown) such that exhaust gas flows in the exhaust pipe. The exhaust gas will be referred to as exhaust hereafter. The intake pipe is provided with devices (not shown) such as an air cleaner and a throttle valve. The exhaust pipe is provided with devices (not shown) such as an exhaust emission control device (e.g., a catalytic converter) and a muffler.

The variable intake system has the intake manifold 1 and a variable intake control valve (not shown). As shown FIG. 1, the intake manifold 1 is provided with paths (i.e., first paths) 13 and paths (i.e., second paths) 14 that are communicated with the intake passage of the engine. The variable intake control valve is disposed in the intake manifold 1.

Figure 1:
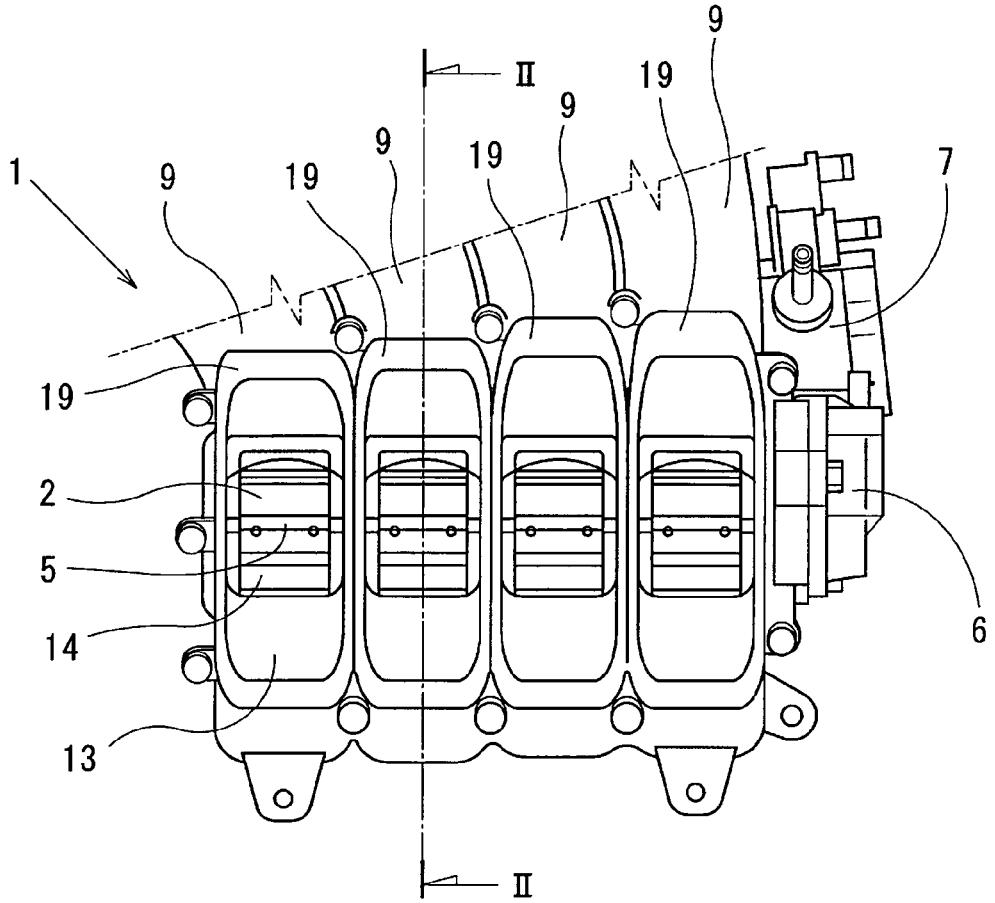
FIG. 1 is a schematic front view of an intake manifold according to a first embodiment.
Figure 2:
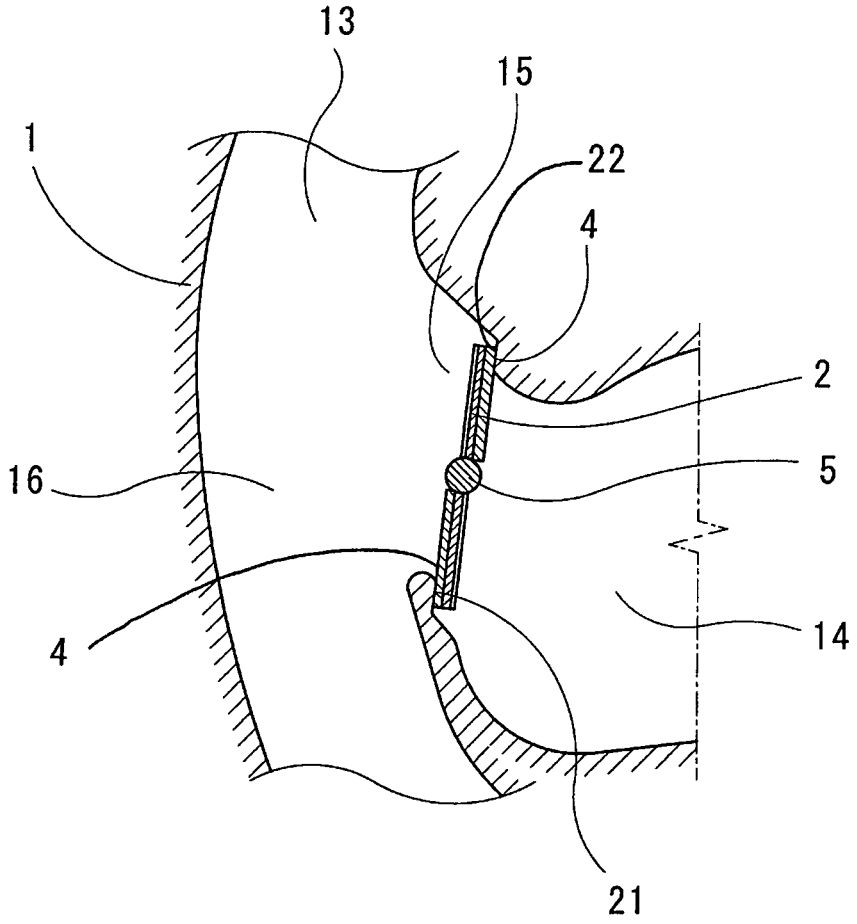
FIG. 2 is a cross-sectional view taken along a line II-II shown in FIG. 1.
Figure 3:
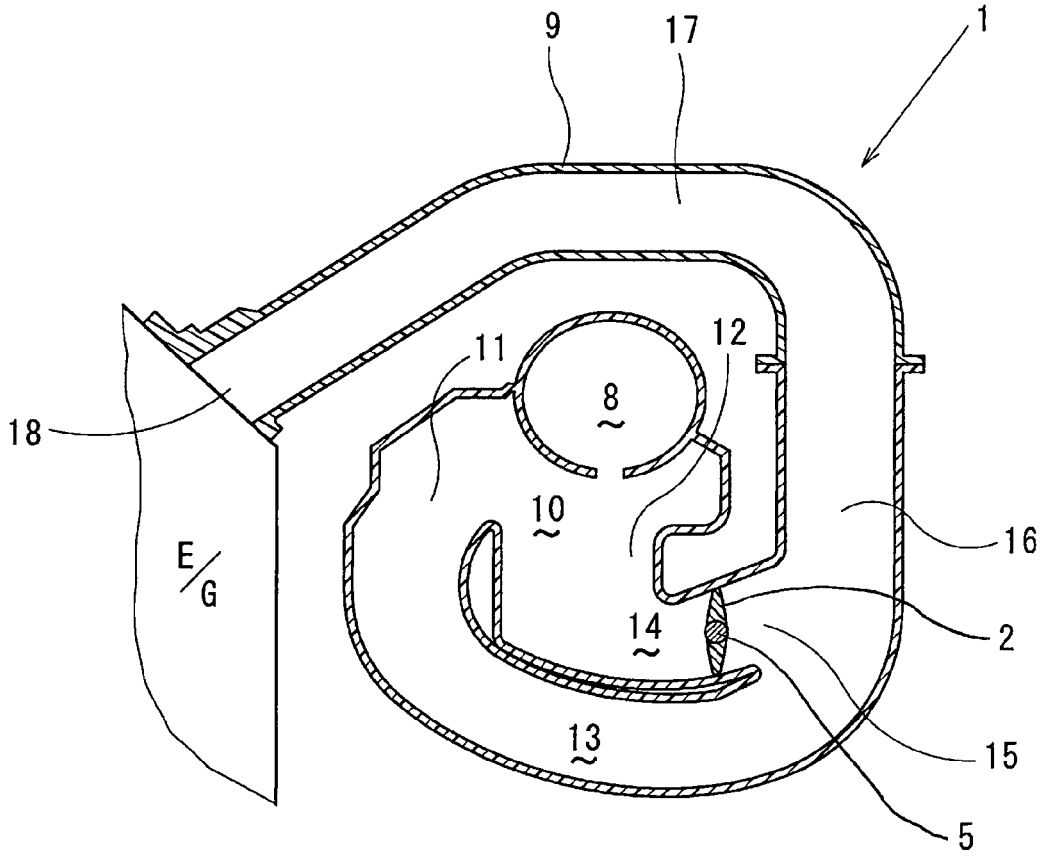
FIG. 3 is a cross-sectional view illustrating an example of an inner structure of the intake manifold according to the first embodiment.

The variable intake control valve has butterfly valves 2, a valve shaft 5, an actuator 6, and return springs (not shown), as shown in FIG. 1. The butterfly valves 2 will be referred to as plate valves 2 hereafter. The plate valves 2 fits to or separates from a valve seat 21 and a valve seat 22 disposed in the intake manifold 1 so as to open or close the second path 14 communicating with the intake passage of the engine, as shown in FIGS. 2 and 3. The number of the plate valves 2 is equal to the number of the cylinders of the engine. Each of the plate valves 2 includes a periphery part 3, and an elastic sealing member (i.e., a lip seal) 4 is disposed at the periphery part 3. That is, the periphery part 3 and the elastic sealing member 4 are the same as the plate valves 2 in number.

Figure 4A:
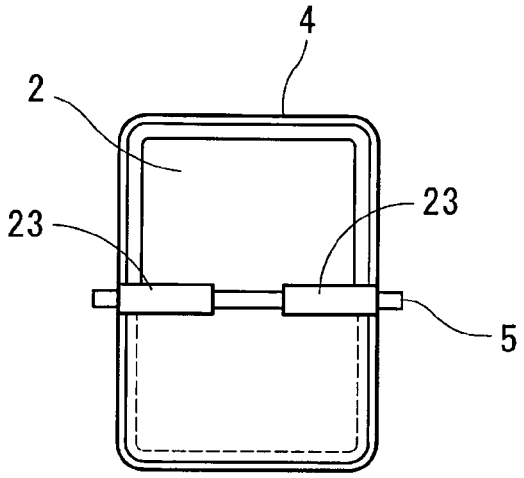
FIG. 4A is a schematic front view illustrating one of plate valves according to the first embodiment.
Figure 4B:
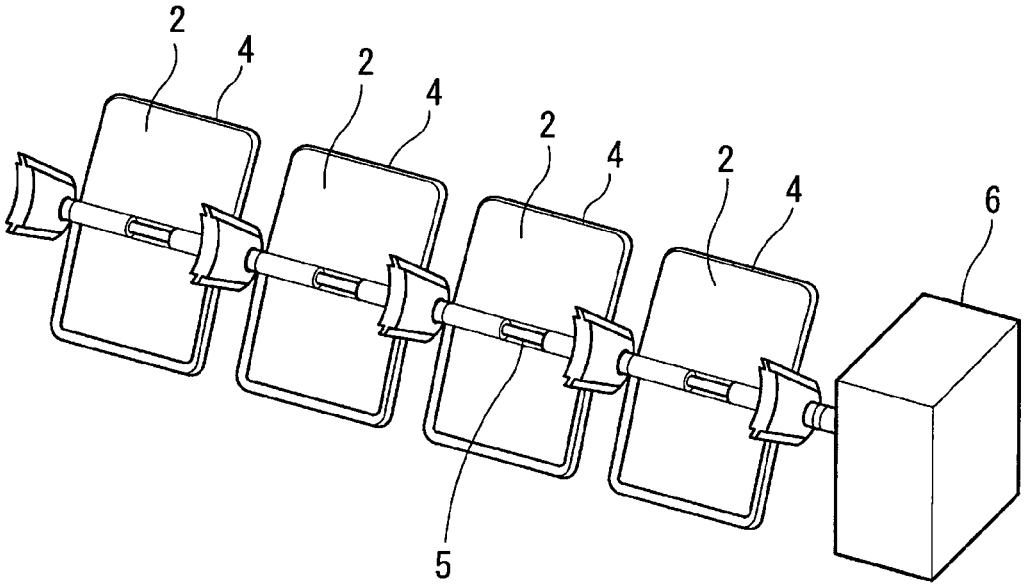
FIG. 4B is a schematic perspective view illustrating the plate valves and an actuator according to the first embodiment.

The valve shaft 5 passes through a shaft supporting part (i.e., a rotation axis part) 23 that is disposed at each of the plate valves 2, as shown in FIGS. 4A and 4B. The actuator 6 is capable of operating the plate valves 2 all together through the valve shaft 5 so as to change an opening degree, in other words, a rotation angle, of each of the plate valves 2. The return springs biases the plate valves 2 in a closing direction or an opening direction. An electric control unit (i.e., an ECU) (not shown) controls energization of a motor (not shown), which is a power source of the actuator 6, so that the opening degree of the plate valves 2 is controlled to be a target opening degree corresponding to the operation condition of the engine. For example, the opening degree is controlled to be fully closed, fully open, or intermediately open.

The intake manifold 1 has a surge tank (not shown) and intake branch pipes 9. The intake branch pipes 9 will be referred to as branch pipes 9 hereafter. The surge tank reduces a pressure fluctuation of intake air that flows into the intake manifold 1 from an outlet end of a throttle body 7 through an air connector 8. The throttle body 7 therein has a throttle valve (not shown) such that the throttle valve can be open or closed in the throttle body 7. The surge tank is provided with a first communication hole 11 and a second communication hole 12. Each of the branch pipes 9 is connected to the first communication hole 11 and the second communication hole 12, as shown in FIG. 3. The number of the first communication hole 11 and the number of the second communication hole 12 are equal to the number of the cylinders. The air connector 8 is connected with a gas-introducing pipe in which gas such as exhaust gas recirculation (EGR) gas, blowby gas, or fuel vapor gas flows.

The surge tank has a surge tank chamber 10 therein. The surge tank chamber 10 may correspond to the intake passage of the engine. The surge tank chamber 10 temporarily stores intake air which flows into the surge tank chamber 10 from an intake air introducing hole (i.e., an intake-introducing hole) (not shown) connected with the throttle body 7 through the air connector 8. Each of the branch pipes 9 therein has one first path 13, one second path 14, a merging part (i.e., an intake air merging part) 16, and an intake-introducing passage 17. The first path 13 is communicated with the surge tank chamber 10 through a first communication hole 11, and the second path 14 is communicated with the surge tank chamber 10 through a second communication hole 12. In the merging part 16, intake air flowing through the first path 13 and intake air flowing through the second path 14 are joined. The intake-introducing passage 17 communicates with the first path 13 and the second path 14 through the merging part 16.

The intake-introducing passage 17 communicates with the combustion chamber through the intake port of the cylinder. The intake-introducing passage 17 includes an intake-introducing port 18, which introduces intake air from the first path 13 or the second path 14 to the combustion chamber and to the intake port of each of the cylinders. An outlet end of each of the branch pipes 9 corresponds to an opening periphery of the intake-introducing port 18. The opening periphery of the intake-introducing port 18 has a flange 19 formed in a rectangular-annular shape. The flange 19 is fastened to an attachment surface of engine, to which a cylinder head is attached, by using fastening bolts. The flange 19 is the same as the cylinders in number.

As shown in FIG. 3, the first path 13 extends from the first communication hole 11 to the merging part 16. The first communication hole 11 is open at a wall surface of the surge tank chamber 10 at a downstream side in a flow direction of intake air. The second path 14 extends from the second communication hole 12 to the merging part 16. The second communication hole 12 is open at another part of the wall surface to be separated from the first communication hole 11 at the downstream side in the flow direction of the intake air. A length of the first path 13 is longer than a length of the second path 14.

Since the length of the second path 14 is shorter than the length of the first path 13, a pressure loss (i.e., a ventilation resistance) of intake air flowing through the second path 14 is smaller than a pressure loss (i.e., a ventilation resistance) of intake air flowing through the first path 13. Accordingly, intake air, which is introduced from the air connector 8 to the surge tank chamber 10, flows easier into the second branch passage 14 than into the first branch passage 13. However, the intake-introducing passage 17 may be unnecessary, and the merging part 16 located downstream of the first path 13 and the second path 14 may be provided in the intake port of each of the cylinders for the engine. Further, the first path 13 and the second path 14 may be different from each other in sectional area, instead of being different from each other in length. In this case, a sectional area of the second path 14 is larger than a sectional area of the first path 13.

Each of the branch pipes 9 has a valve seat 21 and a valve seat 22 that are formed generally in a rectangular-semiannular shape. The valve seat 21 and the valve seat 22 are integrally disposed around an outlet part (i.e., a valve hole 15) of the second path 14. In other words, the valve seat 21 and the valve seat 22 are disposed around an opening periphery of the valve hole 15, as shown in FIG. 2. The elastic sealing member 4 can tightly fit to the valve seat 21 and the valve seat 22.

The valve hole 15 is, in other words, a passage hole passing through the valve seats 21, 22 in a flow direction of intake air. The valve hole 15 has a part that is provided inside the valve seats 21, 22 and a part that is open at a wall surface of the merging part 16 at an upstream side of the merging part 16 in the flow direction of the intake air and that provides an outlet port of the second path 14.

The variable intake system of the present embodiment can vary a length from the first communication hole 11 and the second communication hole 12 to the merging part 16. In other words, the variable intake system of the present embodiment can switch an intake path between the first path 13 and the second path 14 to vary a length of the intake path. Accordingly, the variable intake system can use pulsation effect of intake air and inertia supercharging effect that are caused in the intake passage of the engine, so as to increase an output torque of the engine. The inertia supercharging effect is supercharging effect that uses inertia force due to pulsation of intake air drawn into the combustion chamber so as to draw intake air into the combustion chamber as much as possible.

The variable intake system has the intake manifold 1 and the variable intake control valve. The intake manifold 1 includes the valve seats 21, 22, and the variable intake control valve is disposed in the intake manifold 1. As described above, the variable intake control valve includes the plate valves 2, the valve shaft 5, and the actuator 6. Each of the plate valves 2 has a rectangular shape and opens or closes the valve hole 15. By opening or closing the valve hole 15, the intake path is switched between the first path 13 and the second path 14. Accordingly, the length of the intake path is varied. The plate valve 2 is located upstream of the merging part 16 in the flow direction of intake air in the branch pipe 9, in other words, in the second path 14, as shown in FIG. 3.

As shown in 4B, the plate valves 2 are connected to the valve shaft 5 to be arranged one after another in an axial direction of the valve shaft 5 such that the rotation axis of each of the plate valves 2 is parallel with an axis of the valve shaft 5. The plate valves 2 rotate around the valve shaft 5. Each of the plate valves 2 is formed in a curve shape in a cross section. The opening degree of the plate valves 2 can be changed in a changeable range that is from an opening degree, at which the second path 14 is fully closed, to an opening degree, at which the second path 14 is fully open. That is, the plate valves 2 are moved in a changeable range from the fully closed position to the fully open position. Each of the plate valves 2 rotates relatively with respect to the branch pipe 9. Each of the plate valve 2 has the shaft supporting part 23 having a cylindrical shape, and the shaft supporting part 23 covers the valve shaft 5 in a circumferential direction. The shaft supporting part 23 therein provides a through hole passing through the shaft supporting part 23 in the axial direction of the valve shaft 5. The through hole has a shape such as tetragon and polygon in cross section. The shaft supporting part 23 has an opening part 24 at a center part of the rotation axis part 23 in the axial direction, and the valve shaft 5 is exposed at the opening part 24. The plate valve 2 has a first surface 25 formed in a rectangular shape, a second surface 26 formed in a rectangular shape, and an outer peripheral surface 27 formed in a rectangular-tube shape. The first surface 25 and the second surface 26 are opposite to each other in the thickness direction of the plate valve 2.

Figure 5A:
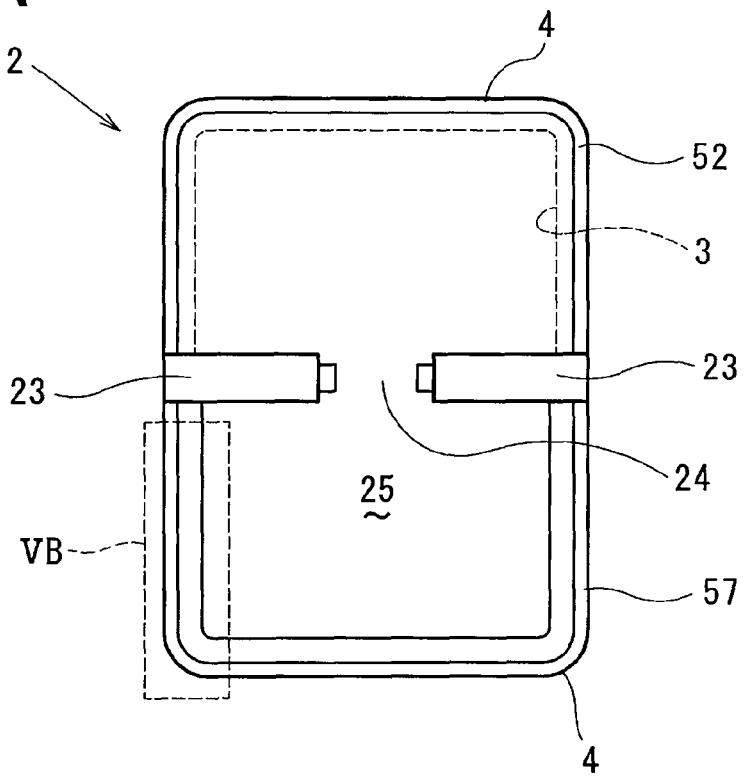
FIG. 5A is a schematic front view illustrating the single plate valve according to the first embodiment.
Figure 5B:
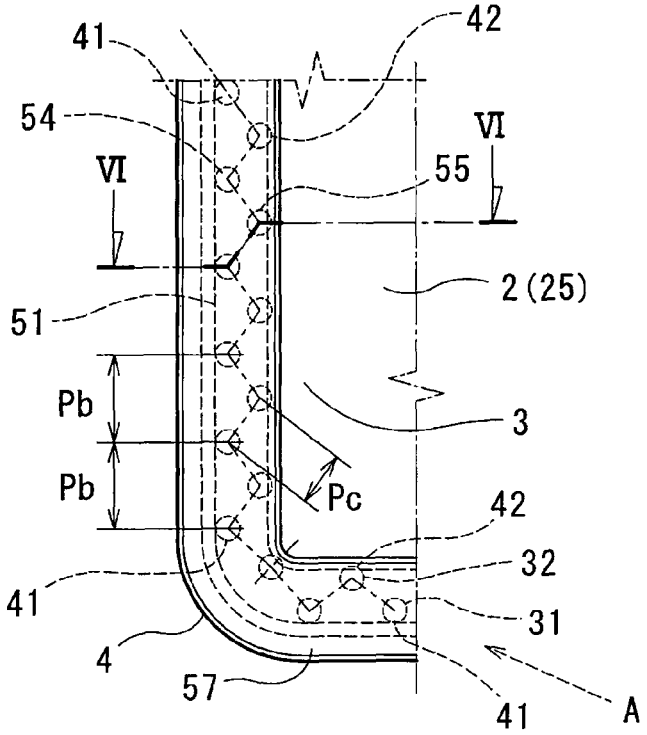
FIG. 5B is a partial enlarged front view of a part VB shown in FIG. 5A.

The plate valve 2 includes a valve periphery part 3, which extends in a peripheral direction of the plate valve 2, as shown in FIG. 5A. The valve periphery part 3 has a predetermined thickness in the thickness direction of the plate valve 2. The valve periphery part 3 has an arrangement pattern A forming an annular band area. As shown in FIG. 5B, the arrangement pattern A is provided by through holes 41 and through holes 42 passing through the plate valve 2 in the thickness direction at the valve periphery part 3. The through holes 41 are aligned one after another in the peripheral direction to form a first row 31, and the through holes 42 are aligned one after another in the peripheral direction to form a second row 32. That is, the through holes 41 and the through holes 42 that are aligned to form the first row 31 and the second row 32 are arranged as the arrangement pattern A.

Figure 6:
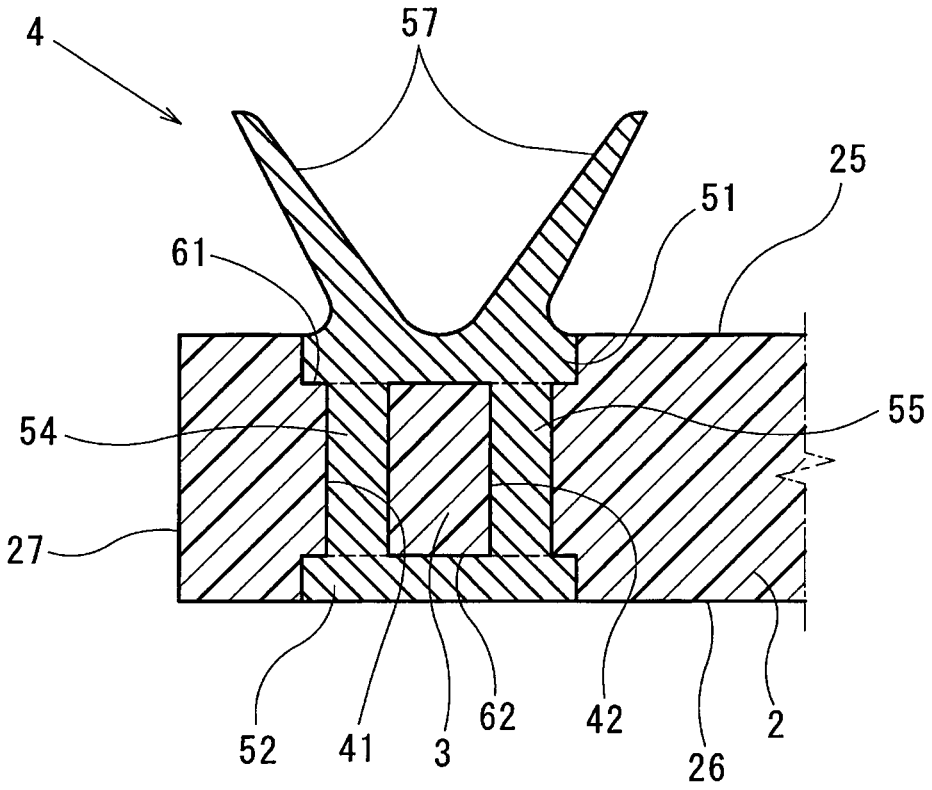
FIG. 6 is a cross-sectional view taken along a line VI-VI shown in FIG. 5B.

As shown in FIG. 6, the elastic sealing member 4 has an elastic covering part 51 partly covering the first surface 25 and an elastic covering part 52 partly covering the second surface 26.

Details about the plate valves 2 and the elastic sealing member 4 will be described after.

The valve shaft 5 is a polygonal cross-section shaft having a polygonal shape in a cross section perpendicular to the axial direction of the valve shaft 5. For example, the valve shaft 5 is made of steel and is formed in tetragon in the cross section. The plate valves 2 are connected to the valve shaft 5 to be arranged one after another in the axial direction of the valve shaft 5 such that the rotation axis of each of the plate valves 2 is parallel with an axis of the valve shaft 5. Accordingly, the opening degrees of the plate valves 2 can be changed all together so as to change an opening degree of the variable intake control valve. Accordingly, the valve shaft 5 can support the plate valves 2. The valve shaft 5 has valve holding members (not shown), and the valve holding members hold the plate valves 2.

The valve shaft 5 is attached to the intake manifold 1 so as to pass through a through hole that is provided in each of the branch pipes 9 and extends in the rotation axial direction. Both ends of the valve shaft 5 in the axial direction are supported rotatably by a passage wall of each of the branch pipes 9, in other words, a partition wall partitioning one second path 14 from an adjacent second path 14, through a shaft holding member (not shown) such as bearings. One end of the valve shaft 5 is held by a shaft holding hole (not shown) of the intake manifold 1. The other end of the valve shaft 5 protrude from a side wall of the intake manifold 1 and connected to the actuator 6 so as to be driven by the actuator 6.

The actuator 6 includes the motor (not shown) and a gear reducer (not shown). When electric power is supplied to the motor, the motor generates driving power. The plate valves 2 are open or closed based on the driving power. The gear reducer reduces a rotation speed of the motor to approach a predetermined speed reduction ratio by a double reduction. The gear reducer includes a pinion gear fixed to an output shaft of the motor, a middle gear engaging with the pinion gear, and an output gear engaging with the middle gear. The output gear is connected with the valve shaft 5 to rotate integrally with the valve shaft 5. The motor causes the plate valves 2 to be open or closed by driving the valve shaft 5 rotatably. The motor is electrically connected with an exterior power source such as a battery mounted to a vehicle such as an automobile through a motor operating circuit which is electrically controlled by the ECU.

The ECU has a microcomputer that includes at least a central processing unit (CPU), a read-only memory (ROM), and a random-access memory (RAM). In the ECU, output signals, which are output from various sensors such as a crank angle sensor, a throttle opening-degree sensor, a rotation angle detector, a coolant temperature sensor, and an air flow meter, are converted to digital data by an A/D convertor. The converted output signals are input to the microcomputer. The various sensors such as the crank angle sensor, the throttle opening-degree sensor, the rotation angle detector, the coolant temperature sensor, and the air flow meter configure an operation condition detector detecting an engine operation condition (i.e., an engine operation state).

The ECU electrically controls the actuator 6 of the variable intake control valve (specifically, the motor) based on a control program provided in a memory such as the ROM in the microcomputer, when an ignition switch (IG) (not shown) is on. Specifically, in the ECU, an engine rotation speed (i.e., a number of engine rotation: NE) is calculated based on an NE pulse signal that is output from the crank angle sensor. Subsequently, a target opening degree of the variable intake control valve that corresponds to the engine rotation speed (NE) is determined. Then, the electric power to be supplied to the motor is feedback-controlled so as to eliminate a deviation of an actual opening degree of the variable intake control valve from the target opening degree of the variable intake control valve.

Details about the plate valves 2 and the lip seals 4 of the present embodiment will be described referring to FIGS. 1 to 6.

Each of the plate valve 2 is made seamlessly by a synthetic resin. The synthetic resin is not limited to a specific synthetic resin as long as the synthetic resin has thermoplasticity. For example, a synthetic resin such as polyamide (PA) can be used. The plate valve 2 fits to or distances from the valve seat 21 at a part of the plate valve 2 that is located downward of the shaft supporting part 23 in a state shown in FIGS. 2 and 4. The part of the plate valve 2, which fits to or distances from the valve seat 21, corresponds to a part that is located upward of the shaft supporting part 23 in a state shown in FIG. 5. Further, the plate valve 2 fits to or distance from the valve seat 22 at a part of the plate valve 2 that is located upward of the rotation axis part 23 in the state shown in FIGS. 2 and 4. The part of the plate valve 2, which fits to or distances from the valve seat 22, corresponds to a part that is located downward of the rotation axis part 23 in the state shown in FIG. 5. In other words, one short side of the plate valve 2 fits to or distances from the valve seat 21, and the other short side of the plate valve 2 fits to or distances from the valve seat 22.

The plate valve 2 includes the valve periphery part 3 and the arrangement pattern A provided at the valve periphery part 3.

The arrangement pattern A includes the first and second rows 31, 32, in other words, the arrangement pattern A of the present embodiment includes two rows. The first row 31 and the second row 32 are adjacent to each other in a direction perpendicular to the peripheral direction in which the through holes 41 and the through holes 42 are aligned one after another. In other words, each of the first row 31 and the second row 32 extends in the peripheral direction.

The through holes 41 and the through holes 42 are aligned to form the first row 31 and the second row 32, respectively. The through holes 41 and the through holes 42 are arranged alternately in zigzag on a flat surface of the plate valve 2. In other words, the through holes 41 and the through holes 42 are provided such that openings of the through holes 41 and openings of the through holes 42 are alternately arranged in zigzag on the flat surface of the plate valve 2 in the thickness direction. That is, each of the through holes 41 and each of the through holes 42 are arranged to be offset in the direction perpendicular to the peripheral direction, as shown in FIG. 5B. The first row 31 and the second row 32 are arranged in this order from an outer periphery side of the plate valve 2 to a center part (i.e., an inner side) of the plate valve 2. In other words, the first row 31 is located outward of the second row 32.

The first row 31 is formed by the through holes 41, which are aligned one after another along the valve periphery part 3 in the peripheral direction. The second row 32 is formed by the through holes 42, which are aligned one after another along the valve periphery part 3 in the peripheral direction.

In the arrangement pattern A, the through holes 41 form the first row 31, which is one of the two rows, and the through holes 42 form the first row 31, which is the other one of the two rows and adjacent to the first row 31. The through holes 41 and the through holes 42 are alternately arranged in zigzag in the peripheral direction as shown in FIG. 5B. In other words, the through holes 41 and the through holes 42 are arranged such that each of the through holes 41 and each of the through holes 42 are offset in the direction perpendicular to the peripheral direction.

Each of the through holes 41 and each of the through holes 42 are round holes that have a discoid shape in a cross section perpendicular to the thickness direction. The through holes 41, 42 pass through the plate valve 2 at the valve periphery part 3 in the thickness direction of the plate valve 2.

Intervals between the through holes 41 in the peripheral direction are fixed, and intervals between the through holes 42 in the peripheral direction are fixed. That is, the through holes 41 are aligned one after another in the peripheral direction at regular intervals (Pb), and one of the through holes 41 and one of the through holes 42 that is adjacent to the one of the through holes 41 are aligned at regular intervals (Pc). The interval Pb and the interval Pc satisfy a formula of $Pb>Pc$. In the comparison example, the through holes are aligned at regular intervals (Pa) as shown in FIG. 12B. The interval Pa and the interval Pb satisfy a formula of $Pa<Pb$ or a formula of $Pa \leq Pc$.

The elastic sealing member 4 is made of an elastomer and formed seamlessly. The elastomer making the elastic sealing member 4 is not limited to a specific elastomer as long as the elastomer has elasticity. For example, the elastomer may be synthetic rubber such as hydrogenated nitrile rubber (H-NBR), silicon rubber, and fluorine-containing rubber (FPM). Alternatively, the elastomer may be thermoplastic elastomer made of a mixture of polypropylene (PP) and ethylene-propylene rubber (EPDM). Alternatively, the elastomer may be made of a mixture of plural kinds of synthetic rubber and natural rubber.

As shown in FIG. 6, the elastic sealing member 4 has an elastic covering part 51, an elastic covering part 52, elastic connecting parts 54, elastic connecting parts 55, a sealing lip 57, and a peripheral surface covering part (not shown). Each of the elastic covering part 51 and the elastic covering part 52 has a rectangular-annular band shape in a cross section taken along a line perpendicular to the thickness direction of the plate valve 2. The sealing lip 57 has a V-shape in a cross section taken along a line parallel with the thickness direction of the plate valve 2. The peripheral surface covering part has elasticity.

The elastic covering part 51 covers one surface of the plate valve 2 in the thickness direction at the valve periphery part 3 with a predetermined thickness. That is, the elastic covering part 51 partly covers the first surface 25 of the plate valve 2 with the predetermined thickness. In the present embodiment, the elastic covering part 51 fills in a top-surface-side recess part 61. The top-surface-side recess part 61 will be referred to as a first recess part 61 hereafter. The first recess part 61 has an annular band shape in a cross section taken along a line perpendicular to the thickness direction of the plate valve 2 and is provided at the valve periphery part 3. However, the first recess part 61 may not be necessary.

The elastic covering part 52 covers the other surface of the plate valve 2 in the thickness direction at the valve periphery part 3 with a predetermined thickness. That is, the elastic covering part 53 partly covers the second surface 26 of the plate valve 2 with the predetermined thickness. In the present embodiment, the elastic covering part 52 fills in a bottom-surface-side recess part 62. The bottom-surface-side recess part 62 will be referred to as a second recess part 62 hereafter. The second recess part 62 has an annular band shape in a cross section take along a line perpendicular to the thickness direction of the plate valve 2 and is provided at the valve periphery part 3. However, the second recess part 62 may not be necessary.

The elastic connecting parts 54 are located in the through holes 41, respectively, and pass through the through holes 41 in the thickness direction of the plate valve 2 such that the elastic covering part 51 and the elastic covering part 52 are coupled through the elastic connecting parts 54. That is, the elastic connecting parts 54 are parts connecting the elastic covering part 51 and the elastic covering part 52. The elastic covering part 52 will be referred to as a first elastic connecting part.

The elastic connecting parts 55 are located in the through holes 42, respectively, to pass through the through holes 42 in the thickness direction of the plate valve 2 such that the elastic covering part 51 and the elastic covering part 52 are coupled through the elastic connecting parts 55. That is, the elastic connecting part 55 are parts that connect the elastic covering part 51 and the elastic covering part 52. The elastic covering part 52 will be referred to as a second elastic connecting part.

The sealing lip 57 gas-tightly seals a clearance, which is provided between the valve periphery part 3 and the valve seats 21, 22 when the variable intake control valve is fully closed. The sealing lip 57 is capable of deforming elastically in all directions. The peripheral surface covering part covers an outer peripheral surface of the valve periphery part 3 with a predetermined thickness in a direction perpendicular to the thickness direction of the plate valve 2.

An operation of the variable intake system of the present embodiment will be described hereafter.

The ECU performs an energizing control to control the motor of the actuator so as to fully close the plate valves 2 when the rotation speed of the engine is in a range of a low rotation speed. The sealing lip 57 is disposed at each of the elastic sealing members 4 that is disposed at each of the plate valves 2. Accordingly, when the ECU controls the plate valves 2 to be fully closed, the sealing lip 57 of each of the plate valves 2 fits tightly to each of the valve seats 21, 22 of the intake manifold 1, and the outlet parts (i.e., the valve holes 15) of the second path 14 are closed.

When the variable intake control vale is fully closed, intake air flows from the first communicating hole 11 to only the first path 13. The intake air in the first path 13 is introduced to flow from the intake-introducing port 18 of the intake-introducing passage 17 to the combustion chamber. The intake-introducing passage 17 is communicated with the intake port that is provided to each of the cylinders to communicate with the combustion chamber and that is opened by the intake valve. Accordingly, the intake air flows from the intake-introducing port 18 to the combustion chamber through the intake port. In this case, a length of an intake passage that extends from the surge tank chamber 10 to the merging part 16 is relatively long compared to the second path 14. Accordingly, an intake-air charging efficiency can be high when intake air is charged into the engine in a case where the inertia supercharging effect is performed and the rotation speed is in the range of the low rotation speed. Therefore, an engine output can be improved.

The ECU performs an energizing control to control the motor of the actuator so as to fully open the plate valves 2 when the rotation speed of the engine is in a range of high rotation speed. Accordingly, the sealing lip 57 of each of the elastic seal members 4 moves to distance from the valve seats 21, 22, and each of the outlet parts (i.e., the valve holes 15) of each of the second path 14 is open. When the variable intake control vale is fully open, intake air flows from the second communicating hole 11 to the second path 14.

The intake air in the second branch passage 14 is introduced to flow from the intake-introducing port 18 of the intake-introducing passage 17 to the combustion chamber. The intake-introducing passage 17 is communicated with the intake port. Accordingly, the intake air flows from the intake-introducing port 18 to the combustion chamber through the intake port.

In this case, a length of an intake passage that extends from the surge tank chamber 10 to the merging part 16 is relatively short compared to the first path 13. Further, a cross-sectional area of the intake passage provided in the case where the second path 14 is open is larger than a cross-sectional area of the intake passage provided in a case where only the first path 13 is open. Accordingly, an intake-air charging efficiency can be high when intake air is charged into the engine in a case where the inertia supercharging effect is performed and the rotation speed is in the range of the low rotation speed. Therefore, an engine output can be improved.

As described above, according to the present embodiment, the variable intake control valve used in the variable intake system has the plate valves 2, and each of the plate valves 2 has the arrangement pattern A which includes the through holes 41 and the through holes 42. Each of the through holes 41, 42 passes through the plate valve 2 from the first surface 25 to the second surface 26 in the thickness direction of the plate valve 2 at the valve periphery part 3.

In the arrangement pattern A, the through holes 41 are aligned one after another along the peripheral direction to form the first row 31, and the through holes 42 are aligned one after another along the peripheral direction to form the second row 32. The first row 31 and the second row 32 are arranged to be adjacent to each other in the direction perpendicular to the peripheral direction.

The through holes 41 and the through holes 42 are arranged such that the through holes 41 and the through holes 42 are offset to each other in the direction perpendicular to the peripheral direction. In other words, the through holes 41 and the through holes 42 are arranged in zigzag in the peripheral direction.

Each of the elastic sealing members 4 has the sealing lip 57 sealing the clearance provided between the valve periphery part 3 and the valve seats 21, 22. The elastic seal member 4 is fixed to the valve periphery part 3.

The elastic sealing member 4 has the elastic covering part 51, the elastic covering part 52, the elastic connecting parts 54, and the elastic connecting parts 55. The elastic covering part 51 and the elastic covering part 52 cover both surfaces of the plate valve 2 in the thickness direction. In other words, the elastic covering part 51 and the elastic covering part 52 cover the first surface 25 and the second surface 26 of the plate valve 2, respectively. The elastic connecting parts 54 and the elastic connecting parts 55 fill the through holes 41 and the through holes 42, respectively.

Each of the elastic connecting parts 54 passes through each of the through holes 41 in the thickness direction of the plate valve 2, and the elastic covering part 51 and the elastic covering part 52 are connected to each other through the elastic connecting parts 54. Each of the elastic connecting parts 55 passes through each of the through holes 42 in the thickness direction of the plate valve 2, and the elastic covering part 51 and the elastic covering part 52 are connected to each other through the elastic connecting parts 55. Accordingly, the elastic sealing member 4 can be fixed to the valve periphery part 3 without having an adhesion layer between the elastic sealing member 4 and the valve periphery part 3. Therefore, holding strength to hold the elastic sealing member 4 can be increased, and strength of the plate valve 2 itself can be restricted from decreasing.

Since the interval Pb is shorter than the interval Pa between the through holes of the comparison example, the holding strength can increases and the valve periphery part 3 can hold the elastic sealing member 4 tightly. Therefore, the holding strength to hold the elastic sealing member 4 can increase, and the strength of the plate valves 2 itself can be restricted from decreasing, without shortening of the interval Pb. Further, a manufacturing cost can be reduced by omitting an adhesion process for adhering the elastic sealing member 4 to the valve periphery part 3 and by restricting an increase of the number of components and assembling steps.

Further, since the elastic sealing member 4 can be fixed to the valve periphery part 3 more reliably, a leak amount of intake air decreases when the variable intake control valve is fully closed. Accordingly, the sealing effect can be improved.

Moreover, the elastic sealing member can be fixed to the valve periphery part 3 even when the elastic seal member 4 is made of a thermoplastic elastomer which is disable to be adhered with a synthetic resin.

Since the adhesion process is unnecessary, the manufacturing cost can be reduced. The manufacturing cost can be further reduced by using the thermoplastic elastomer which is lower in cost than a synthetic rubber.

(Second Embodiment)

An intake system of a second embodiment will be described referring to FIG. 7.

Figure 7:
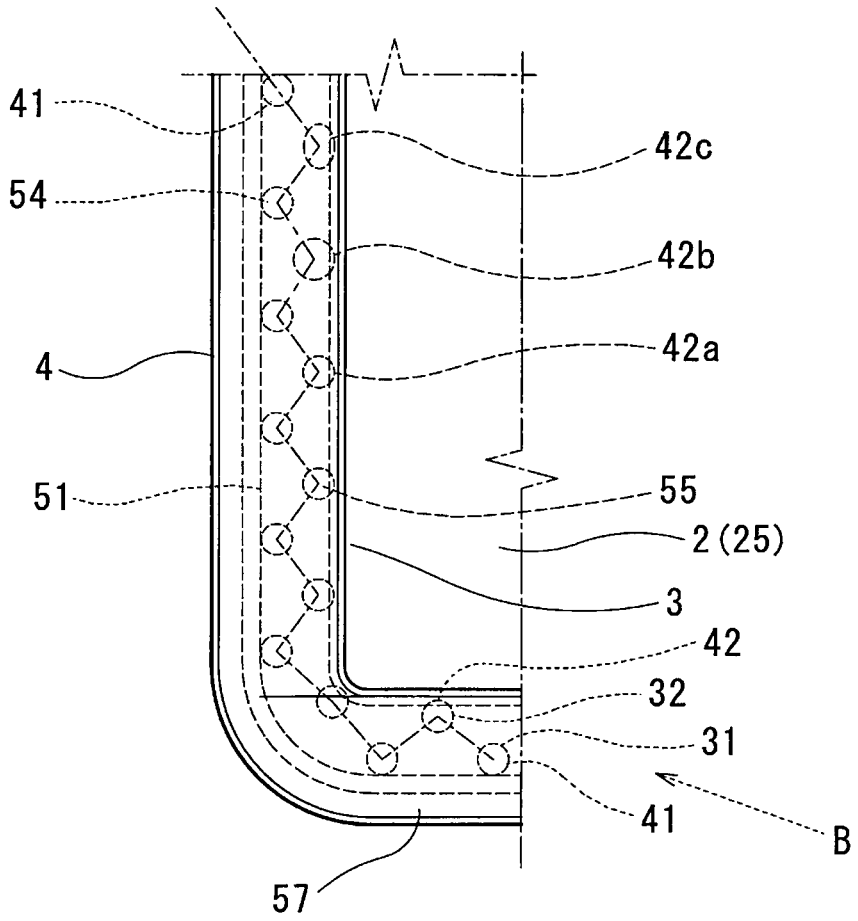
FIG. 7 is a partial enlarged front view illustrating a part of one of plate valves according to a second embodiment.

In FIG. 7, components of the intake system of the second embodiment, which have the same structures or functions as the components of the intake system of the first embodiment, are shown with the same reference numbers as that of the first embodiment.

The plate valve 2 of the present embodiment has an arrangement pattern B including the through holes 41 and the through holes 42. The arrangement pattern B forms a rectangular-annular band shape. Each of the through holes 41 and each of the through holes 42 pass through the plate valve 2 in the thickness direction at the valve periphery part 3 such that the first surface 25 and the second surface 26 of the plate valve 2 are communicate with each other through the through holes 41 and the through holes 42.

In the arrangement pattern B, the through holes 41 are aligned one after another in the peripheral direction of the plate valve 2 and form the first row 31, and the through holes 42 are aligned one after another in the peripheral direction of the plate valve 2 and forms the second row 32. That is, the first and second rows 31, 32 are provided in the arrangement pattern B of the second embodiment.

According to the second embodiment, the through holes 41 and the through holes 42 are provided to include two kinds of through holes or to include three or more kinds of through holes. For example, the through holes 41 and the through holes 42 include different kinds of through holes that are different from each other in cross-sectional shape and in cross-sectional size at a cross section taken along a line perpendicular to the thickness direction of the plate valve 2.

The cross-sectional shape of the through holes 41 and the through holes 42 are not limited to a discoid shape. For example, the cross-sectional shape of the through holes 41 and the through holes 42 may be an oblong-hole shape and a polygon shape. The through holes 41 and the through holes 42 are not limited to be the same in size in the cross section. The through holes 41 and the through holes 42 may include two different sizes or include three or more different sizes.

The through holes 41 and the through holes 42 are alternately arranged in zigzag on a flat surface of the plate valve 2, as shown in FIG. 7. In other words, the through holes 41 and the through holes 42 are provided such that openings of the through holes 41 and openings of the through holes 42 are alternately arranged in zigzag on the flat surface of the plate valve 2 in the thickness direction. That is, each of the through holes 41 and each of the through holes 42 are offset in the direction perpendicular to the peripheral direction.

The different kinds of through holes, which are included in the through holes 41 and the through holes 42 are arranged randomly. In other words, an arrangement order of the different kinds of through holes is irregular in the present embodiment.

That is, the through holes 41 and the through holes 42 may include the different kinds of through holes such as a through hole 42*a*, a through hole 42*b*, a through hole 42*c* shown in FIG. 7 so as to be different in the cross-sectional shape and the cross-sectional size. The arrangement order of the through holes 42*a*, 42*b*, and 42*c* is not limited to be irregular and may be regular.

The cross-sectional shape and the cross-sectional size can be varied as long as the strength of the plate valve 2 itself and the holding strength, with which the elastic sealing member 4 is fixed to the valve periphery part 3 securely, are balanced.

Thus, the intake system of the present embodiment can perform similar effects that are performed by the intake system of the first embodiment.

(Third Embodiment)

An intake system according to a third embodiment will be described referring to FIG. 8.

Figure 8:
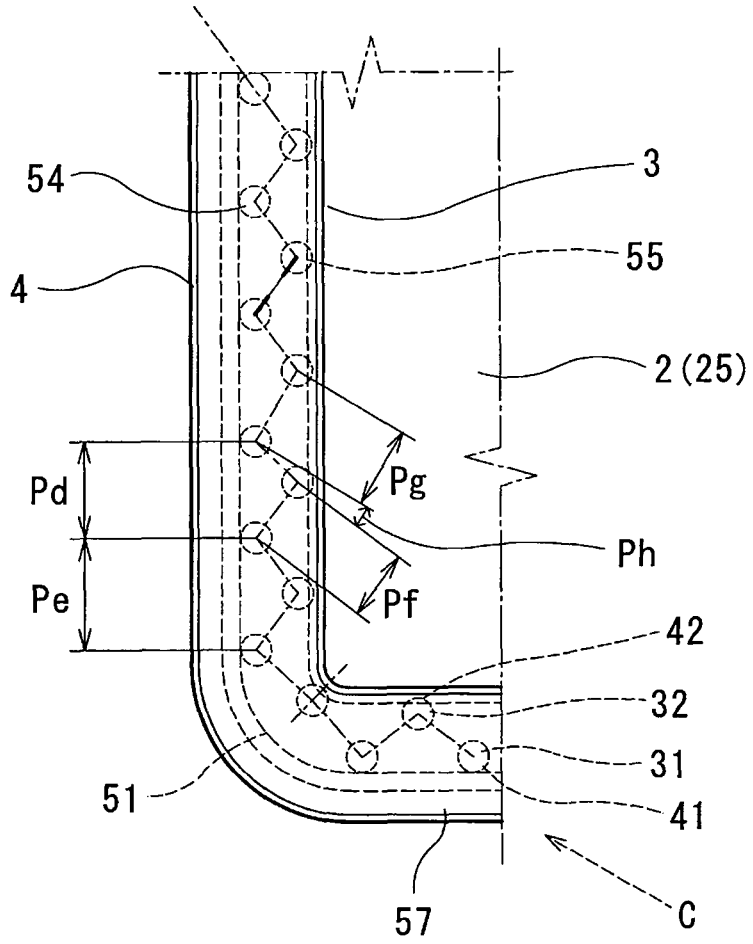
FIG. 8 is a partial enlarged front view illustrating a part of one of plate valves according to a third embodiment.

In FIG. 8, components of the intake system of the third embodiment, which have the same structures or functions as the components of the intake system of the above embodiments, are shown with the same reference numbers as that of the above embodiments.

The plate valve 2 of the present embodiment has an arrangement pattern C including the through holes 41 and the through holes 42, which pass through the plate valve 2 from the first surface 25 to the second surface 26 in the thickness direction of the plate valve 2 at the valve periphery part 3. The arrangement pattern C forms a rectangular-annular band shape.

In the arrangement pattern C, the through holes 41 are aligned one after another in the peripheral direction of the plate valve 2 and form the first row 31, and the through holes 42 are aligned one after another in the peripheral direction of the plate valve 2 and form the second row 32. That is, the arrangement pattern C of the present embodiment includes two rows.

According to the present embodiment, the through holes 41 are aligned one after another at irregular intervals, for example, an interval Pd and an interval Pe shown in FIG. 8. Further, the through holes 41 and the through holes 42 are arranged such that intervals between one of the through holes 41 and an adjacent through hole 42 are irregular. For example, one of the through hole 41 and an adjacent through hole 42 are arranged at an interval Pf, an interval Pg, or an interval Ph, as shown in FIG. 8. That is, the intervals Pd, Pe, Pg, Pf are different from each other and satisfy a formula of $Pd \neq Pe \neq Pg \neq Pf$. Moreover, the intervals Pg, Pf, Ph satisfy a formulas of $Ph<Pg$, $Ph<Pf$, and $Pg<Pf$.

Although the through holes 41 and the through holes 42 are aligned at irregular intervals as described above in the present embodiment, the through holes 41 and the through holes 42 may be aligned at regular intervals.

The cross-sectional shape and the cross-sectional size of the through holes 41 and the through holes 42 can be varied as long as the strength of the plate valve 2 itself and the holding strength, with which the elastic sealing member 4 is fixed to the valve periphery part 3 securely, are balanced.

Therefore, the intake system of the present embodiment can perform the similar effects that are similar to the effects of the first and second embodiments.

(Fourth Embodiment)

An intake system of an fourth embodiment will be described referring to FIG. 9.

Figure 9:
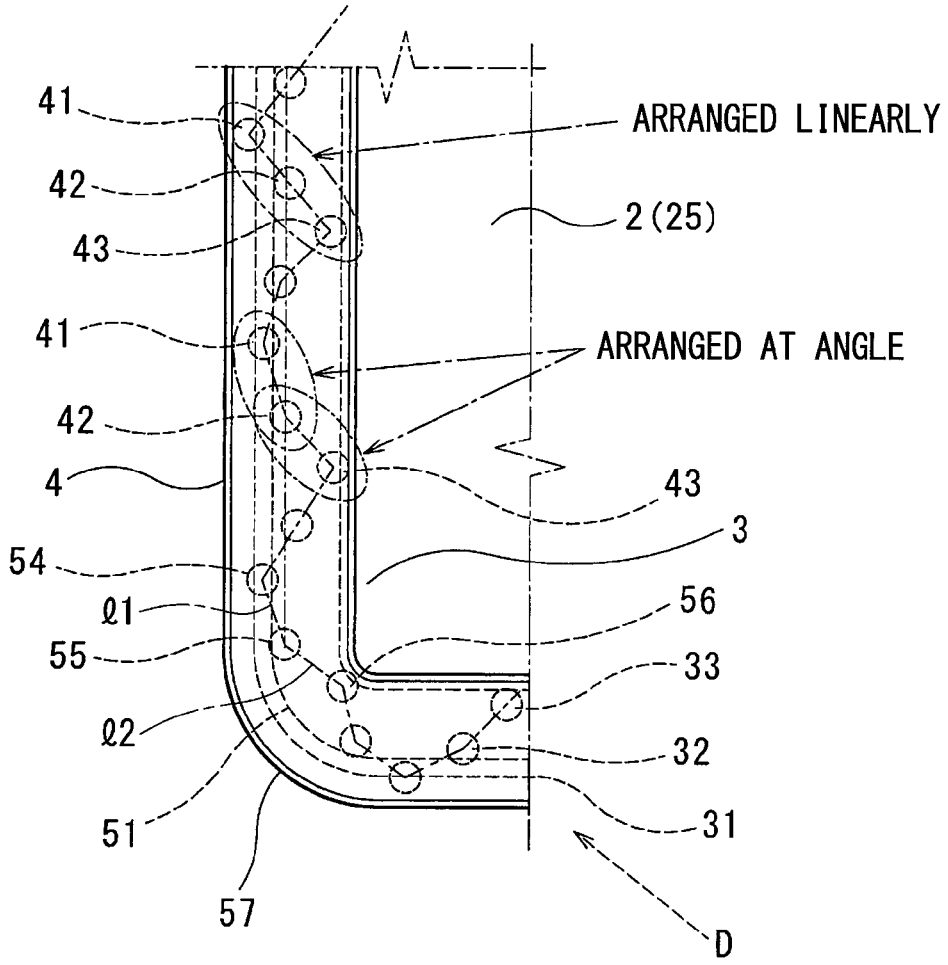
FIG. 9 is a partial enlarged front view illustrating a part of one of plate valves according to a fourth embodiment.

In FIG. 9, components of the intake system of the fourth embodiment, which have the same structures or functions as the components of the intake system of the above embodiments, are shown with the same reference numbers as that of the above embodiments.

The plate valve 2 of the present embodiment has an arrangement pattern D including the through holes 41, the through holes 42, and through holes 43. Each of the through holes 41, 42, 43 passes through the plate valve 2 from the first surface 25 to the second surface 26 in the thickness direction of the plate valve 2. The through holes 41 are aligned one after another in the peripheral direction and form the first row 31. The through holes 42 are aligned one after another in the peripheral direction and form the second row 32. The through holes 43 are aligned one after another in the peripheral direction and form a third row 33. The arrangement pattern D forms a rectangular-annular band shape.

The arrangement pattern D includes three rows according to the present embodiment.

The through holes 41, 42, 43 includes at least three different kinds of through holes that are different from each other in cross-sectional shape or in cross-sectional size at a cross section taken along a line perpendicular to the thickness direction.

The through holes 41, 42, 43 are arranged such that one through hole 41, one through hole 42, and one through hole 43 adjacent to each other are offset in the direction perpendicular to the peripheral direction.

In the arrangement pattern D, the first row 31, the second row 32, and the third row 33 are arranged in this order from the outer side to the inner side of the plate valve 2. In other words, the first row 31 is located outward of the second row 32, and the third row 33 is located inward of the second row 32.

The through holes 41, 42, 43 are arranged such that one through hole 42, an adjacent through hole 41 that is adjacent to the through hole 42, and an adjacent through hole 43 that is adjacent to the through hole 42 are on a linear line that is angled with respect to the direction perpendicular to the peripheral direction.

Alternatively, the through holes 41, 42, 43 may be arranged not to be on the linear line. In other words, when a line connecting the through hole 42 and the adjacent through hole 41 is defined as a line I1, and when a line connecting the through hole 42 and the adjacent through hole 43 is defined as a line I2, the line I1 and the line I2 may be at an angle to each other. Both of the line I1 and the line I2 are angled relative to the direction perpendicular to the peripheral direction.

The elastic sealing member 4 of the present embodiment further has elastic connecting parts 56. Each of the elastic connecting parts 56 is located to pass through each of the through hole 43 such that the elastic covering part 51 and the elastic covering part 52 are connected with each other through the elastic connecting parts 56. The elastic connecting part 56 will be referred to as third elastic connecting part.

That is, the number of the rows is not limited to two as described in the above embodiments, and three or more than three rows are provided as long as a space of the plate valve 2 permits.

The through hole 42, the adjacent through hole 41, and the adjacent through hole 43 are not limited to be aligned to form a straight line. As described above, the through hole 42, the adjacent through hole 41, and the adjacent through hole 43 may be arranged such that the line I1 and the line I2 are at angle to each other.

The cross-sectional shape and the cross-sectional size of the through holes 41, the through holes 42, and the through hole 43 can be varied as long as the strength of the plate valve 2 itself and the holding strength, with which the elastic sealing member 4 is fixed to the valve periphery part 3 securely, are balanced.

Therefore, the intake system of the present embodiment can perform the similar effects that are similar to the effects of the above embodiments.

An intake system of the fifth embodiment will be described referring to FIGS. 10 and 11.

Figure 10:
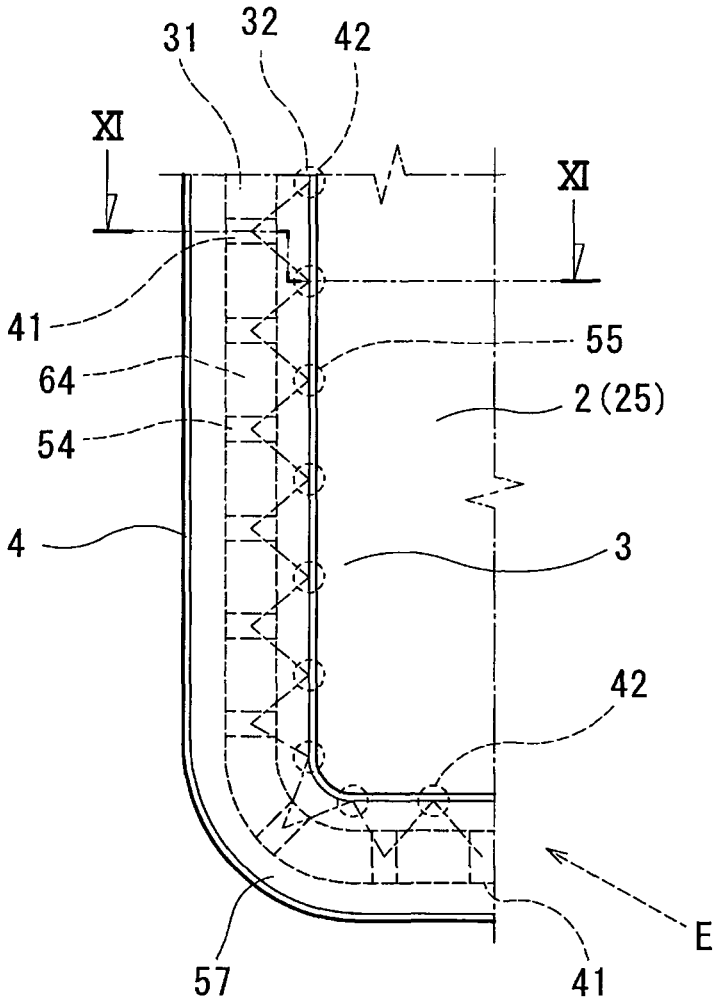
FIG. 10 is a partial enlarged front view illustrating a part of one of plate valves according to a fifth embodiment.
Figure 11:
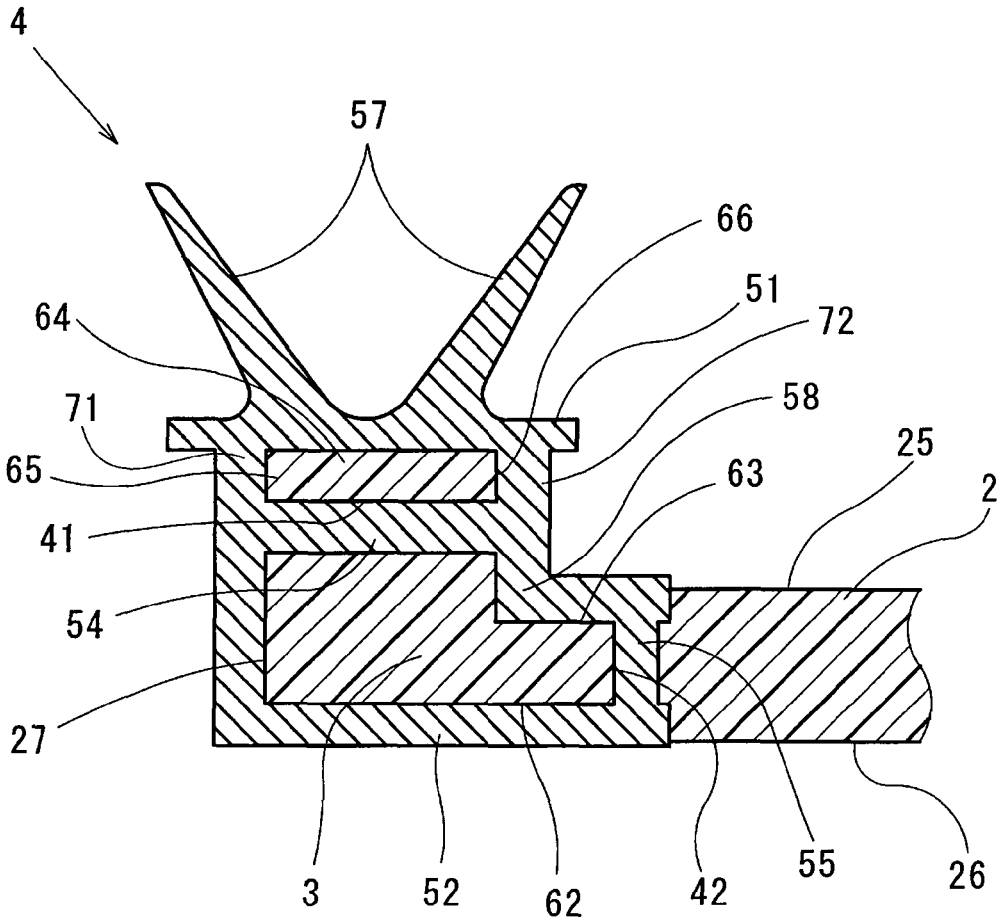
FIG. 11 is a cross-sectional view taken along a line XI-XI shown in FIG. 10.

In FIGS. 10 and 11, components of the intake system of the fifth embodiment, which have the same structures or functions as the components of the intake system of the above embodiments, are shown with the same reference numbers as that of the above embodiments.

As shown in FIG. 11, the valve periphery part 3 has a top-surface side recess part 63 at a top-surface side of the valve periphery part 3 that is the same side of the plate valve 2 having the first surface 25. The top-surface side recess part 63 will be referred to as a third recess part 63. The third recess part 63 is filled with a elastic covering member 58. The third recess part 63 forms an annular band shape along the valve periphery part 3. At the valve periphery part 3, a protruding part 64 is provided, and the protruding part 64 protrudes from the first surface 25 toward the valve seat side. The protruding part 64 has an annular band shape along the valve periphery part 3, and is intermittently formed along the valve periphery part 3. The through holes 41 are provided at the protruding part 64 such that the through holes 41 pass through the protruding part 64 from an outer surface 65 to an inner surface 66. An axial direction of the through holes 41 is perpendicular to an axial direction of the through holes 42. A tip surface of the protruding part 64 is covered by the elastic covering part 51. The elastic sealing member 4 of the present embodiment includes an elastic covering part 71 covering the outer surface 65 and an elastic covering part 72 covering the inner surface 66.

The through holes 41 and the through holes 42 are arranged three-dimensionally, according to the present embodiment. In other words, the through holes 41 and the through holes 42 extend in different directions such that openings of the through holes 41 and openings of the through holes 42 are not on the same flat surface.

That is, the through holes 41 and the through holes 42 are not limited to be offset to each other in the direction perpendicular to the peripheral direction while the openings of the through holes 41 and the openings of the through holes 42 are on the flat surface, as described in the first to third embodiments. As shown in FIGS. 10 and 11, the through holes 41 and the through holes 42 can be offset to each other in the direction perpendicular to the peripheral direction while the openings of the through holes 41 and the openings of the through holes 42 are not on the same flat surface.

The cross-sectional shape and the cross-sectional size of the through holes 41 and the through holes 42 can be varied as long as the strength of the plate valve 2 itself and the holding strength, with which the elastic sealing member 4 is fixed to the valve periphery part 3 securely, are balanced.

Further, according to the plate valve 2 of the present embodiment, flexibility of the sealing lip 57 can be improved, and the strength of the plate valve 2 can be improved.

The intake system of the present embodiment can perform the similar effects that are similar to the effects of the above embodiments.

The actuator 6 of the above embodiments is an electric actuator that has the motor and the gear reducer and operates the plate valves 2. However, the actuator 6 may be an electromagnetic actuator (i.e., a solenoid actuator) or a negative pressure operation actuator that has an electromagnetic negative-pressure control valve or an electric negative-pressure control valve.

The plate valve 2 is not limited to a butterfly valve and may be a flap valve, a rotary valve, a poppet valve, a spool valve, or the like.

The intake system of the present application is used for the variable intake system. However, the intake system may have an electronic throttle that is an intake system for an internal combustion engine and has a throttle valve controls a flow amount of intake air to be supplied to the internal combustion engine.

Alternatively, the intake system may have a tumble control valve that causes a vertical intake flow (i.e., a tumble flow) in a combustion chamber of the internal combustion engine by causing a linear intake flow (i.e., a drift). The linear intake flow is at one side in the combustion chamber in a height direction of an intake port of the internal combustion engine. The height direction is parallel with a sliding direction of a piston of the internal combustion engine.

Alternatively, the intake system may have a swirl control valve that causes a horizontal intake flow (i.e., a swirl flow) in a combustion chamber of the internal combustion engine by causing a linear intake flow (i.e., a drift). The linear intake flow is at one side in the combustion chamber in a width direction of an intake port of the internal combustion engine. The width direction is perpendicular to a sliding direction of a piston of the internal combustion engine.

The plate valve 2 is not limited to be a valve, in which multiple plate valves are integrated, and may be a single valve as long as being a valve to be disposed in a fluid passage such as an intake passage of an internal combustion engine.

Such changes and modifications are to be understood as being within the scope of the present disclosure as defined by the appended claims.

What is claimed is:

1. An intake system comprising:

a valve seat through which a path is provided to communicate with an intake passage of an internal combustion engine;

a plate valve fitting to the valve seat to close the path or separating from the valve seat to open the path; and an elastic sealing member covering the plate valve from both sides in a thickness direction of the plate valve, wherein the plate valve has a valve periphery part and a plurality of through holes passing through the plate valve in the thickness direction at the valve periphery part, the plurality of through holes are arranged as an arrangement pattern in which the plurality of through holes are arranged in zigzag one after another in a peripheral direction of the plate valve to be offset to each other in a direction perpendicular to the peripheral direction and are aligned to form a plurality of rows that extend in the peripheral direction, and the elastic sealing member includes:

an elastic covering part that covers a first surface and a second surface of the plate valve in the thickness direction at the valve periphery part; and a plurality of elastic coupling parts that are disposed in the plurality of through holes, respectively, to pass through the plurality of through holes and that are coupled with the elastic covering part at the first surface and the second surface.

2. The intake system according to claim 1, wherein
the plurality of rows include a first row having a plurality of first through holes and a second row having a plurality of second through holes, and
the first row is located outward of the second row in the direction perpendicular to the peripheral direction.

3. The intake system according to claim 2, wherein
the plurality of elastic coupling parts include a plurality of first elastic coupling parts and a plurality of second elastic coupling parts,
the plurality of first elastic coupling parts are disposed in the plurality of first through holes, respectively, to pass through the plurality of first through holes and are connected with the elastic covering part at the first surface and the second surface, and
the second elastic coupling parts are disposed in the plurality of second through holes, respectively, to pass through the plurality of second through holes and are connected with the elastic covering part at the first surface and the second surface.

4. The intake system according to claim 2, wherein
the plurality of rows further include a third row having a plurality of third through holes, and
the third row is located inward of the second row in the direction perpendicular to the peripheral direction.

5. The intake system according to claim 4, wherein
the plurality of elastic coupling parts further include a plurality of third elastic coupling parts, and
the plurality of third elastic coupling parts are disposed in the plurality of third through holes, respectively, to pass through the plurality of third through holes and are connected with the elastic covering part at the first surface and the second surface.

6. The intake system according to claim 1, wherein
the elastic sealing member is made of a synthetic rubber that is elastically deformed at least in a contact direction in which the plate valve contacts the valve seat.

7. The intake system according to claim 1, wherein
the elastic sealing member is made of a thermoplastic elastomer that is elastically deformed at least in a contact direction in which the plate valve contacts the valve seat.

8. The intake system according to claim 1, wherein
the plate valve is made of a synthetic resin.

9. The intake system according to claim 1, wherein
the plurality of through holes include at least two variations of through holes formed in different shapes or sizes in a cross section taken along a line perpendicular to the thickness direction.

10. The intake system according to claim 1, wherein
the plurality of through holes include at least three variations of through holes formed in different shapes or sizes in a cross section taken along a line perpendicular to the thickness direction, and
the variant through holes are located randomly in the arrangement pattern.

11. The intake system according to claim 1, wherein
the plurality of through holes are aligned at regular intervals or at partly regular intervals in the peripheral direction, or the plurality of through holes are aligned at irregular intervals in the peripheral direction.

12. The intake system according to claim 4, wherein
one of the plurality of second through holes, one of the plurality of first through holes that is adjacent to the second through hole, and one of the plurality of third through holes that is adjacent to the second through hole are arranged along a straight line that is angled relative to the direction perpendicular to the peripheral direction.

13. The intake system according to claim 4, wherein
one of the plurality of second through holes and one of the plurality of first through holes that is adjacent to the one of the plurality of second through holes are aligned in a first straight line,
the one of the plurality of second through holes and one of the plurality of third through holes that is adjacent to the one of the plurality of second through holes are aligned in a second straight line, and
the first straight line and the second straight line are angled relative to the direction perpendicular to the peripheral direction and are angled to each other.

14. The intake system according to claim 1, wherein
the plurality of through holes extend in the same parallel direction.

15. The intake system according to claim 1, wherein
the plurality of through holes extend in different nonparallel directions.

* * * * *